US005611760A

United States Patent [19]

Jordan

[11] Patent Number: 5,611,760

[45] Date of Patent: Mar. 18, 1997

[54] FLEXIBLE ATHLETIC TRAINING PERIMETER SYSTEM

[76] Inventor: Dicky R. Jordan, 224 Dee Dee St., Longview, Tex. 75602

[21] Appl. No.: 646,689

[22] Filed: May 6, 1996

Related U.S. Application Data

[63] Continuation-in-part of Ser. No. 413,122, Mar. 29, 1995, Pat. No. 5,542,894.

[51] Int. Cl.[6] ..... A63B 71/02

[52] U.S. Cl. ..... 482/83; 482/93

[58] Field of Search ..... 482/23, 74, 82, 482/83, 148; 472/92, 93

[56] References Cited

U.S. PATENT DOCUMENTS

| | | | |
|---|---|---|---|
| 1,032,139 | 7/1912 | Hart | 482/83 |
| 1,753,328 | 4/1930 | Barnes | 472/93 |
| 2,726,866 | 12/1955 | Nally | 472/93 |
| 3,172,660 | 3/1965 | Wallace et al. | 482/82 |
| 5,542,894 | 8/1996 | Jordan | 482/83 |

FOREIGN PATENT DOCUMENTS

| | | | |
|---|---|---|---|
| 2614346 | 10/1988 | France | 472/93 |

*Primary Examiner*—Stephen R. Crow
*Attorney, Agent, or Firm*—David G. Henry

[57] ABSTRACT

The invention is of an athletic perimeter or "ring" system which is cost effective to purchase and use, is easily transported between locations, and admits use in several configurations—open or closed, square, rectangular, triangular, etc. The system is free-standing, and consists of several corner posts which are interlockable with several fence sections. When assembled, the system resembles a boxing ring, but the "ropes" are actually high tension steel. The rigidity of the "ropes" provide the inherent stability of the system and allow it to be free-standing, without attachment of corner posts to a floor surface. The substantially rigid "ropes", unlike actual ropes of boxing rings, also provide support for exercises, such as leg stretching. Accessory frames are provided for supporting accessories such as punching bags, etc. The system represents a highly cost-effective alternative to traditional boxing rings, and offers benefits to martial arts practitioners which are not provided by boxing rings of any design or cost.

2 Claims, 5 Drawing Sheets

FLEXIBLE ATHLETIC TRAINING PERIMETER SYSTEM

CITATION TO PARENT PATENT APPLICATION

This application is a continuation-in-part with respect to U.S. patent application Ser. No. 08/413,122 filed on Mar. 29, 1995, now U.S. Pat. No. 5,542,894.

BACKGROUND OF THE INVENTION

1. Field of the Invention

Applicant's invention relates to athletic equipment, and more particularly to equipment and accessories useful in training of ring-related sports, such as martial arts.

2. Background Information

While boxing has its traditional "rings" with its ropes, etc., those persons in martial arts training have a need for similar, but distinctly different equipment to aid in their training efforts.

Martial arts training is often done in groups of varying sizes. In addition, many widely varying activities are involved in martial arts training, which activities dictate flexibility in training area layout.

A defined area in which martial arts students train and practice is highly desirable for certain phases of training. This, in turn, might suggest use of a traditional boxing ring. There are, however, significant problems with use of any form of the traditional boxing ring for martial arts practitioners and businesses.

One problem is expense. The three available forms of boxing rings are quite expensive, either directly or indirectly. Pre-fabricated boxing rings must be built on site and costs several thousands of dollars. Another version, also quite expensive, is a portable, trailer-borne structure which is often used for traveling boxing exhibitions. The third version is a training version which is built at a training facility and involves four floor-mounted posts with the intervening ropes. This last version is usually the least expensive of the three boxing ring types, but is indirectly expensive in that it irreversibly occupies often costly floor space which cannot then be effectively used for other activities. As already mentioned, martial arts training involves a wider variety of training activities, and involves more people per unit training time, than boxing, and therefore requires space not bounded or occupied by a boxing ring support posts and ropes. The cost of leasing sufficient floor space both for a dedicated boxing ring area and for other activities which ideally occur outside of a ring-like area is prohibitive for the many thousands of small, one-owner martial arts studios.

Even if expense were not an issue, boxing rings in the presently known form have only limited utility for martial arts practitioners. The ropes of standard boxing rings are not resilient enough to support leg stretching exercises which are an integral part of any martial arts training or warm-up. Also, the fixed, closed layout of boxing rings inherently rule out alternative layouts, such as a U-shaped configuration as would be desirable for certain exhibition work in martial arts, or perhaps a triangular layout which would be more fitting for certain spaces in which a boxing ring would not fit.

Certainly, martial arts practitioners who do use a ring-like structure for exhibitions, matches, etc. must, in order to have a boxing ring available, incur the substantial expense of renting a facility already having a boxing ring, or lease a portable unit at substantial expense.

SUMMARY OF THE INVENTION

It is an object of the present invention to provide a novel ring-like structure which is particularly suited for use by martial arts practitioners.

It is another object of the present invention to provide a novel ring-like structure for use by martial arts practitioners, which structure is more cost effective than boxing ring construction or use.

It is another object of the present invention to provide a novel ring-like structure for use by martial arts practitioners, which structure admits flexibility of layout.

It is another object of the present invention to provide a novel ring-like structure, particularly for use by martial arts practitioners which is portable.

It is yet another object of the present invention to provide a novel ring-like structure which is particularly suited for use by martial arts practitioners, which structure is cost effective, portable and flexible in layout.

In satisfaction of these and related objectives, Applicant's present invention provides a novel athletic ring system which is cost effective to purchase and use, is easily transported between locations, and admits use in several configurations. Applicant's ring system is particularly suitable for martial arts training, not only with respect to its portability, layout flexibility and portability, but also with respect to the use of "ropes" which are, in fact, high-tension steel which stand up to the forces associated with their use for leg stretching exercises.

DETAILED DESCRIPTION OF THE PREFERRED EMBODIMENT

Figure 1:
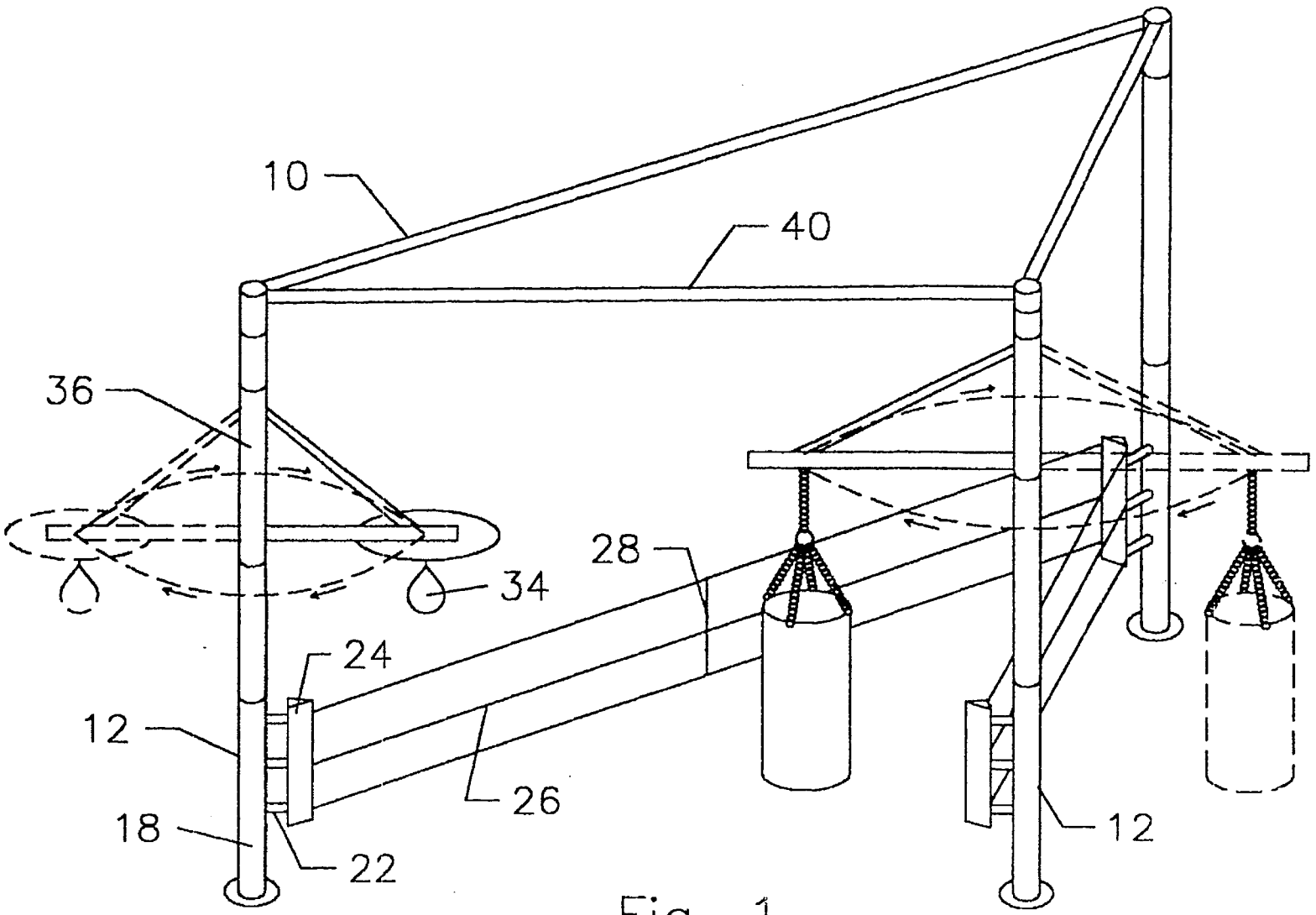
FIG. 1 is a perspective view of the preferred embodiment of Applicant's perimeter system.

Referring to FIG. 1, Applicant's athletic ring system is identified generally by the reference numeral 10. System 10 is shown in FIG. 1 in one of several possible layouts. In this case, the system 10 is configured for a triangular layout which is useful in reserving adjacent floor space for other non-ring activities, or in fitting the system into areas which would not admit a full-sized square ring at all, without regard to floor space division concerns (such as even a home use).

Figure 2:
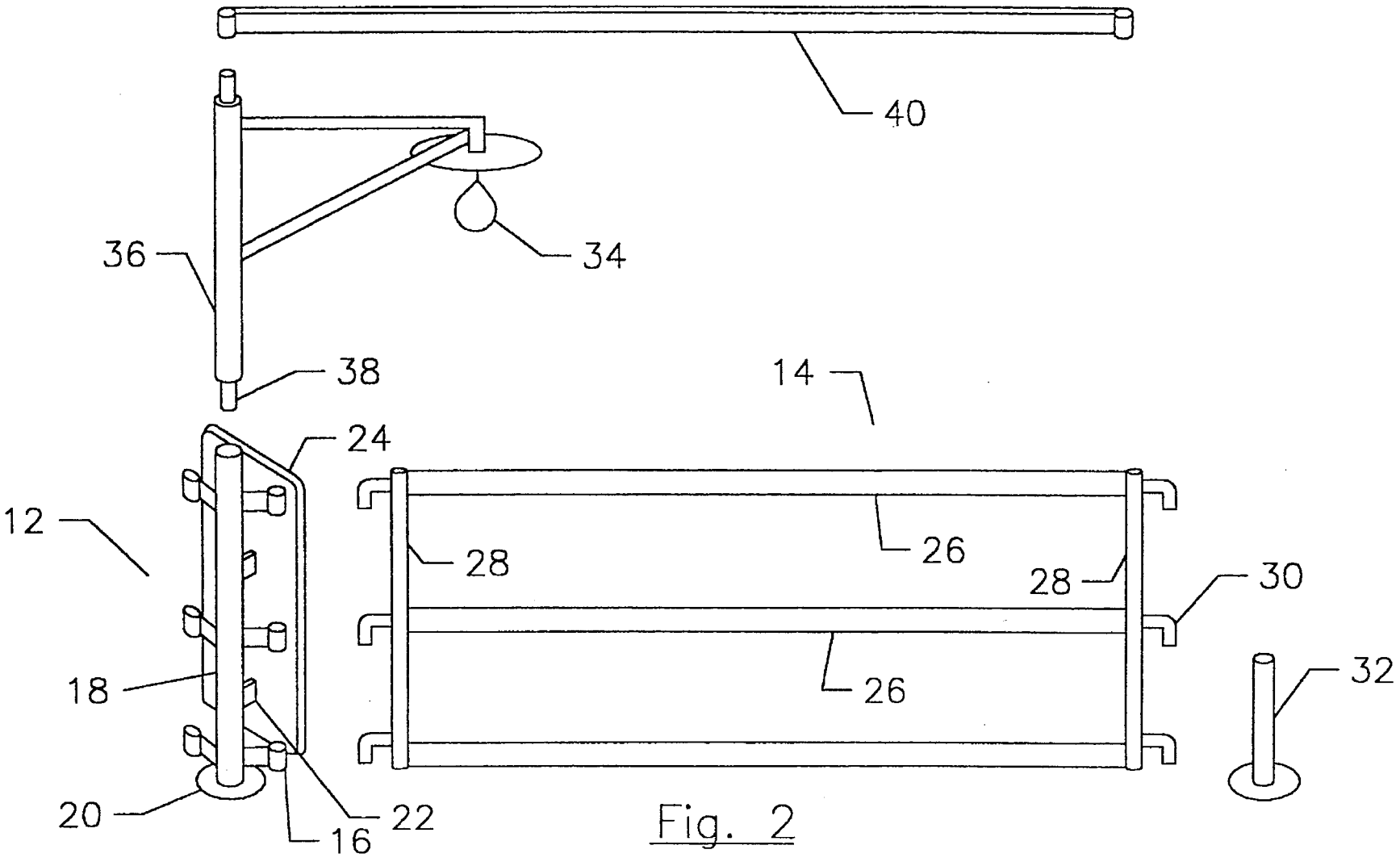
FIG. 2 is an elevational, partially exploded view of a corner post and fence section of the preferred embodiment.

Referring in combination to FIGS. 1 and 2, Applicant's system includes a plurality of corner posts 12 (four for a standard square or rectangular ring configuration). Corner posts 12 couple with a plurality of fence sections 14 to define whatever layout is desired for system 10. As in FIG. 1, three corner posts 12 and two fence sections 14 can be used to define an open, V-shaped configuration. A third fence section 14 could be added to define a closed triangular configuration. Obviously, a fourth corner post 12 and fence section 14 could be added for a square configuration (or rectangular configuration, if two long and two short fence sections 14 are used [fence sections 14 of varying length are not separately depicted-in the drawings, but are within the scope of Applicant's invention]).

Referring particularly to FIG. 2, each corner post 12, for the preferred embodiment of Applicant's invention, includes three pairs of coupling eyes 16. Each pair of coupling eyes 16 extend from the base post 18 at 90° relative angles. A base 20 supports and provides stability for the base post 18. Bisecting the angle formed by the pairs of coupling eyes are pad supports 22 which support a protective pad 24. Protective pad 24 is provided to insure that users of system 10 are not injured should they fall against corner posts 12.

Fence sections 14, on first impression, resemble one side of a boxing ring with three rather than four "ropes." However, ropes 26 of fence sections 14 are actually high-tension steel rods which are padded for safety purposes. Ropes 26 are, in the preferred embodiment, 0.75 inch in diameter. Ropes 26 are connected by welding at their respective opposites ends to fence posts 28 in a perpendicular mating arrangement as shown in the figures. Like ropes 26, fence posts 28 are padded for safety in the preferred embodiment.

Ropes 26 are highly resilient and resistive to forces which would bend them. Ropes 26 provide two primary benefits in system 10, benefits not possibly provided by actual hemp-type or other fibrous ropes: (1) they will withstand downward forces such as accompany use of ropes 26 during leg stretching exercises (a user can jump on ropes 26 with only minor deviation of the rope 26); and (2) they provide some or all of the rigidity for system 10 which enables corner posts 12, and therefore, the entire system 10 to be free-standing (i.e. not attached to a floor surface for a safe and stable installation).

Extending from the opposite sides of each fence post 28 from ropes 26 are three coupling pins 30. Coupling pins 30 are sized and spaced for coupling with coupling eyes 16 of corner posts 12.

Figure 3:
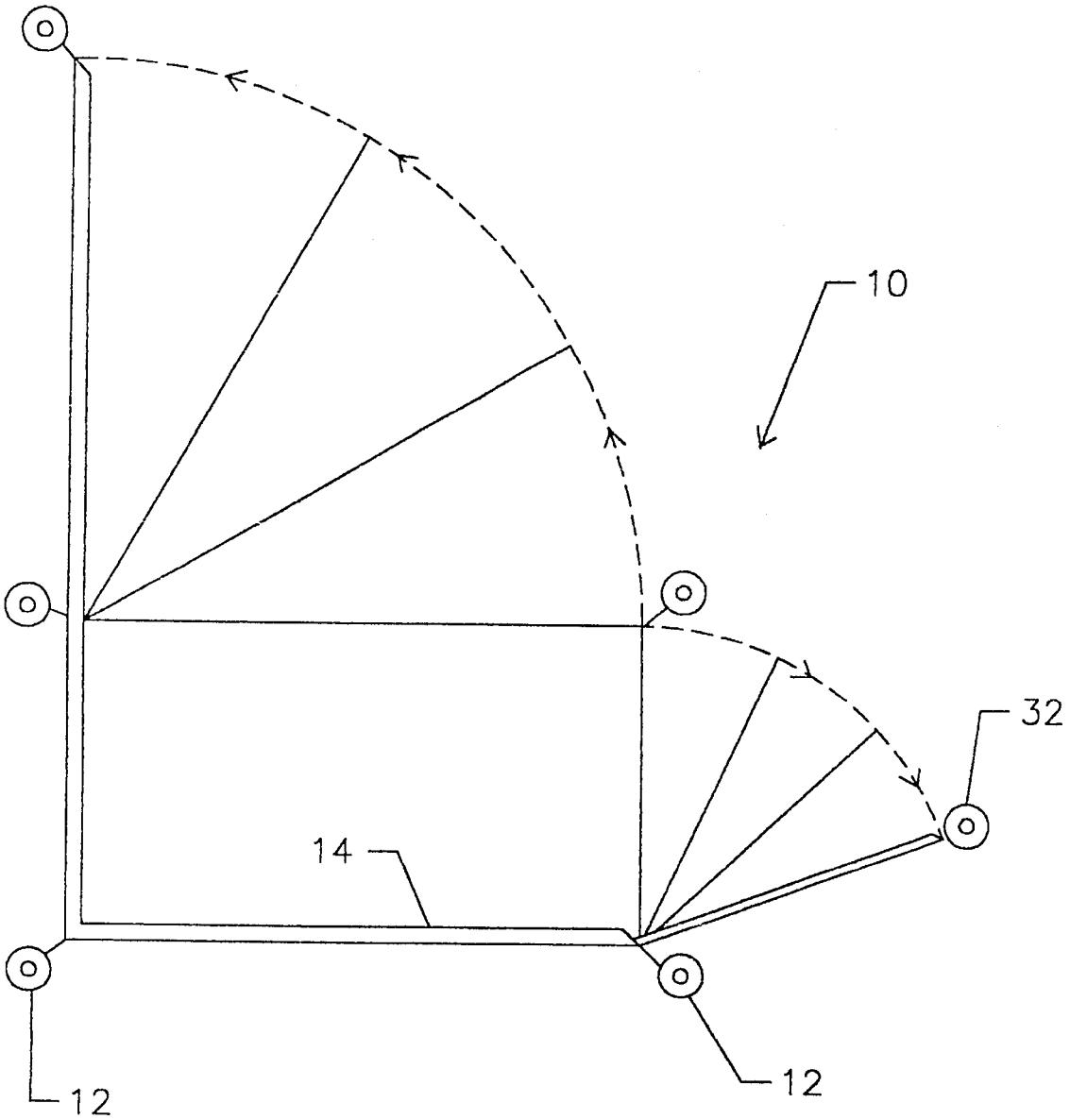
FIG. 3 is a top plan view of alternate configurations of Applicant's system.

Referring in combination to FIGS. 2 and 3, the preferred embodiment of Applicant's invention includes one or more fence stands 32 for use in those occasions when one or more fence sections 14 are disengaged from a corner post 12 and hingedly "opened up" for a ring layout having an open side, or for effectively removing the system 10 from a room by aligning it with walls of a room. Fence stands 32 support the distal, disconnected ends of fence sections 14 as they mate with lowermost coupling pin 30 of the free end of the fence section 14.

Referring again to FIGS. 1 and 2, the flexibility of Applicant's system extends beyond that associated with the mere layout of the fence sections 14 and corner posts 12. Extra equipment, such as speed bags 34, etc., can be added by telescopically engaged accessory posts 36. An insertion end 38 of each accessory post 36 is sized for telescopic reception into the superior end of each base post 18. For safety purposes, a plastic, plug-like member (not shown in the drawings) occupies the open end of each base post 18 when an accessory post 36 is not in place.

The support arms of each accessory post 36 can move in any direction relative to the base post 18 as the accessory post can easily pivot relative to the base post 18. Particularly when accessory posts 18 are used, and heavy items are suspended from them, braces 40 are encouraged to be used. Braces 40 extend between accessory posts 36 of adjacent corner posts 12 and help counter the torque resulting from the heavy accessory.

Applicant's ring system 10 is highly flexible, easy to assemble and disassemble, portable, and a highly effective tool for teaching and practicing martial arts. Ring system 10 provides economic benefits to its user by obviating any need or desire for a more expensive traditional boxing ring, by allowing use of a "ring" without permanently occupying a large portion of floor space, by allowing the conversion of facilities which do not have boxing rings and which may be less expensive to rent for exhibitions into suitable places for exhibitions.

Figure 4:
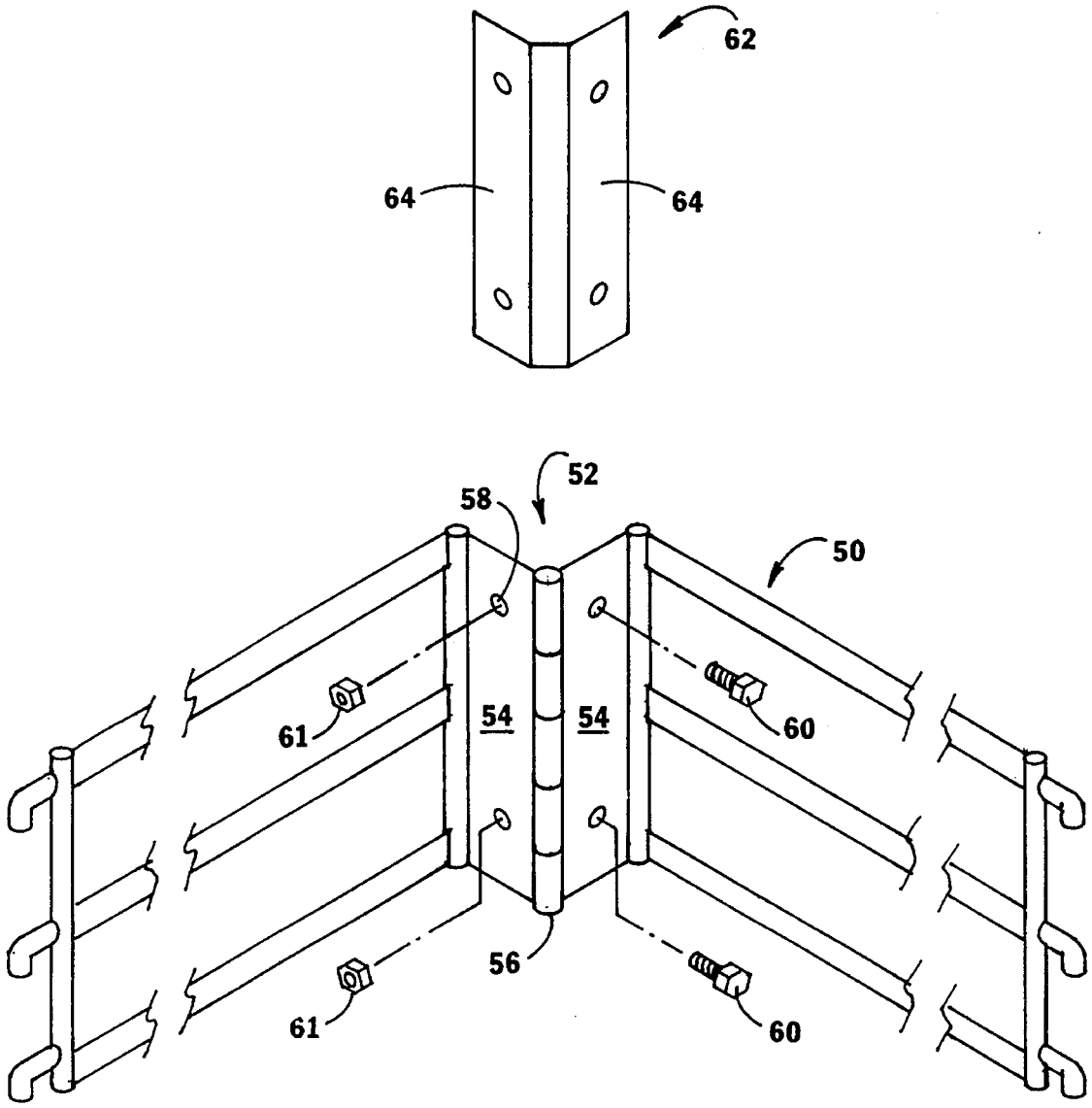
FIG. 4 is a partially exploded perspective view of an alternative embodiment of Applicant's system which includes hinged fence sections for configuration of differing ring shapes and to facilitate storage and transport.
Figure 5:
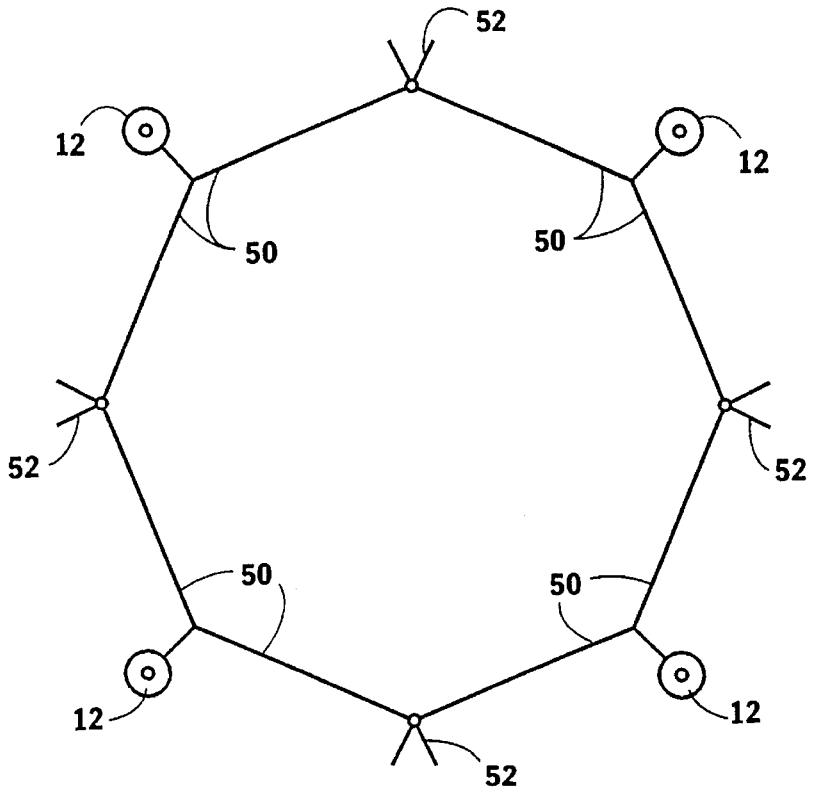
FIG. 5 is a schematic representation of a non-rectilinear ring set up using the hinged embodiment of Applicant's fence sections.
Figure 6:
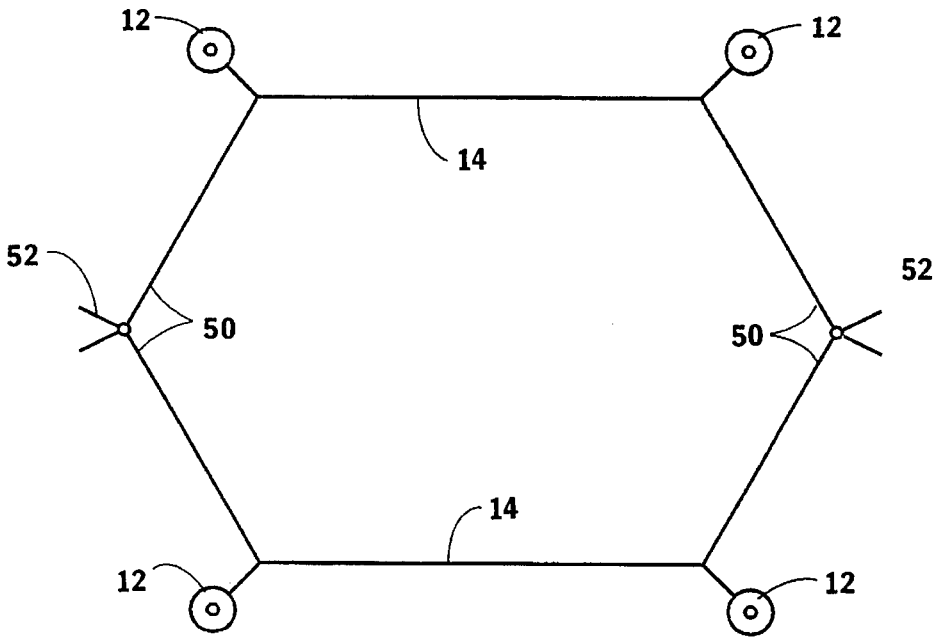
FIG. 6 is a schematic representation of a non-rectilinear ring set up using in combination the two discussed embodiments of Applicant's fence sections.

Referring principally to FIG. 4, an alternative embodiment of Applicant's invention provides fence sections 50 which include a hinge assembly 52 at approximately the midpoint of the span of each fence section 50. End plates 54 are provided adjacent to hinge 56 and include bolt holes 58 through which bolts 60 extend to lock fence section 50 in a desired configuration. For example, if a user wishes fence section 50 to remain in a straight configuration, bolts 60 merely extend though complimentary holes 58 to engage nuts 61 and secure end plates 54 in a closely juxtaposed relationship. This necessarily insures that the two spans of fence section 50 will extend substantially along a single line. Conversely, if, in order to configure a ring with other than straight fence sections (such configurations are schematically shown in FIGS. 5 and 6), fence section 50 is hingedly moved about hinge 56 and secured in the angular configuration using a stabilizing plate 62. The ability to fold fence section 50 about hinge assembly 52 also facilitates more convenient storage and transport of Applicant's system.

Stabilizing plate 62 includes two wings 64 which each exhibit holes 64 corresponding to holes 58 in end plates 54. Wings 64 are angularly disposed such that they impose a substantially equivalent angular relationship upon the spans of fence section 50 on either side of hinge 56 when stabilization plate 62 is secured to end plates 54 using bolts 60 for one wing 64 and end plate 54 and additional bolts (not separately shown) for the other wing 64 and end plate 54.

Of course, a user will desire additional padding (not separately shown) to protect users from contact with the hinge assembly 52.

Although the invention has been described with reference to specific embodiments, this description is not meant to be construed in a limited sense. Various modifications of the disclosed embodiments, as well as alternative embodiments of the inventions, will become apparent to persons skilled in the art upon the reference to the description of the invention. It is, therefore, contemplated that the appended claims will cover such modifications that fall within the scope of the invention.

I claim:

1. An athletic training perimeter system comprising:

a plurality of corner posts, said corner posts having first and second coupling eye pairs of coupling eyes, each said coupling eye of each said coupling eye pair being positioned at substantially the same longitudinal position on said corner post and being relatively positioned on the exterior surface of said corner posts substantially at 90° angles about a longitudinal axis of each said corner posts, said first coupling eye pair being positioned at a first longitudinal corner post position and said second coupling eye pair being positioned at a second longitudinal corner post position;

a plurality of fence sections having first and second fence section ends respectively delineated by first and second fence posts oriented in a parallel relative relationship, extending respectively from said first and second fence posts in perpendicular arrangement with said fence posts are first and second sets of metallic rods, said first set of said metallic rods for each said fence section being fixedly attached to said first fence post at first rod ends and being fixedly attached to a first end plate at second rod ends, a second set of said metallic rods for each said fence section being fixedly attached to said second fence post at first rod ends and being fixedly attached to a second end plate at second rod ends, said first and second end plates being hingedly attached whereby said fence section is moveable from a substantially linear configuration to an angular configuration whereby a first span of said fence section which includes said first fence post and said first end plate extends along a first line, and a second span of said fence section which includes said second fence post and said second end plate extends along a second line angularly displaced from said first line, said fence posts of said fence sections having fixedly attached thereto, in an orientation substantially opposite the attachment site of said metallic rods, first and second coupling pins, a portion of said coupling pins being sized and shaped for telescopic engagement with said coupling eyes, and said coupling pins being positioned on said fence posts for simultaneous mating with said coupling eyes on one said corner post.

2. The system of claim 1 further comprising stabilization means for securing said first and second spans of each said fence section in either said linear or said angular configuration.

* * * * *